US009281590B1

(12) United States Patent
Liu et al.

(10) Patent No.: US 9,281,590 B1
(45) Date of Patent: Mar. 8, 2016

(54) ELECTRICAL CONNECTOR HAVING IMPROVED RESONANCE

(71) Applicant: FOXCONN INTERCONNECT TECHNOLOGY LIMITED, Grand Cayman (KY)

(72) Inventors: Ya-Chi Liu, Placentia, CA (US); Chih-Hsien Chou, San Jose, CA (US); Ze-Lin Yao, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/555,515

(22) Filed: Nov. 26, 2014

(51) Int. Cl.

| | |
|---|---|
| ***H01R 12/72*** | (2011.01) |
| ***H01R 24/66*** | (2011.01) |
| ***H01R 13/652*** | (2006.01) |
| *H01R 107/00* | (2006.01) |

(52) U.S. Cl.
CPC ..... *H01R 12/72* (2013.01); *H01R 13/652* (2013.01); *H01R 24/66* (2013.01); *H01R 2107/00* (2013.01)

(58) Field of Classification Search
CPC ..... H01R 23/7068; H01R 23/688; H01R 23/6873; H01R 23/725
See application file for complete search history.

(56) References Cited

U.S. PATENT DOCUMENTS 6,699,049 B1 * 3/2004 Wu ..... H01R 12/725 439/660
6,916,188 B2 * 7/2005 Lang ..... H01R 13/514 439/101
8,784,123 B1 * 7/2014 Leiba ..... H01R 27/00 439/218
2006/0014433 A1 * 1/2006 Consoli ..... H01R 13/6485 439/607.07
2008/0014803 A1 * 1/2008 Kato ..... H01R 23/6873 439/733.1
2012/0108109 A1 * 5/2012 Zhang ..... H01R 12/721 439/629
2012/0156938 A1 * 6/2012 Zhang ..... H01R 13/6461 439/660
2014/0187086 A1 * 7/2014 Little ..... H01R 13/6585 439/607.34
2014/0220827 A1 * 8/2014 Hsu ..... H01R 13/6594 439/629
2014/0335738 A1 * 11/2014 Chen ..... H01R 24/60 439/660
2015/0031240 A1 * 1/2015 Yang ..... H01R 13/6588 439/607.08

* cited by examiner

*Primary Examiner* — Gary Paumen
(74) *Attorney, Agent, or Firm* — Wei Te Chung; Ming Chieh Chang

(57) ABSTRACT

An electrical connector includes an insulative housing having a longitudinal slot and at least one row of contacts retained in the housing. Each of the contacts defines a retention portion, a resilient contacting arm extending from the retention portion with a contacting portion protruding into the longitudinal slot, and a soldering tail extending out of the housing. The contacts include at least two differential pairs adjacent to each other and at least one grounding contact sandwiched therebetween in the longitudinal direction. The contacting portions of each differential pairs are closer to the mating face than the contacting portion of the grounding contact in the mating direction, which can improve resonance of the electrical connector during transferring high-speed signals.

17 Claims, 9 Drawing Sheets

ELECTRICAL CONNECTOR HAVING IMPROVED RESONANCE

BACKGROUND OF THE INVENTION

1. Field of the Invention

The present invention relates to an electrical connector, and more particular to a card edge connector having higher valve of resonance frequency during transferring high-speed signals.

2. Description of the Related Art

Card edge connectors are employed widely in computers to receive a memory card for increasing memory capacity of the computers. With rapid development of electronic industry, the computer requires a card edge connector for transferring high-speed signals. Therefore, the card edge connector is arranged with a plurality of grounding contacts, and a plurality of differential contact pairs for transferring differential signals. The grounding contacts and the differential contact pairs are arranged in one row. However, while the memory card is inserted into the card edge connector, the resonances of contacts in the card edge connector are increased at the same time. Thus it affects the high-speed signal transmission stability of card edge connector.

Therefore, a new design is required.

SUMMARY OF THE INVENTION

Accordingly, an object of the present invention is to provide an electrical connector having improved resonance during transferring high-speed signals.

In order to achieve the object set forth, an electrical connector includes an insulative housing and at least one row of contacts retained in the housing. The housing defines a longitudinal slot along a longitudinal direction and extending in a mating direction to run through a mating face thereof. Each of the contacts defines a retention portion for being retained to the housing, a resilient contacting arm extending from the retention portion with a contacting portion protruding into the longitudinal slot, and a soldering tail extending out of the housing. The contacts include at least two differential pairs adjacent to each other and at least one grounding contact sandwiched therebetween in the longitudinal direction. The contacting portions of each differential pairs are closer to the mating face than the contacting portion of the grounding contact in the mating direction.

Other objects, advantages and novel features of the invention will become more apparent from the following detailed description of the present embodiment when taken in conjunction with the accompanying drawings.

DETAILED DESCRIPTION OF THE INVENTION

Figure 1:
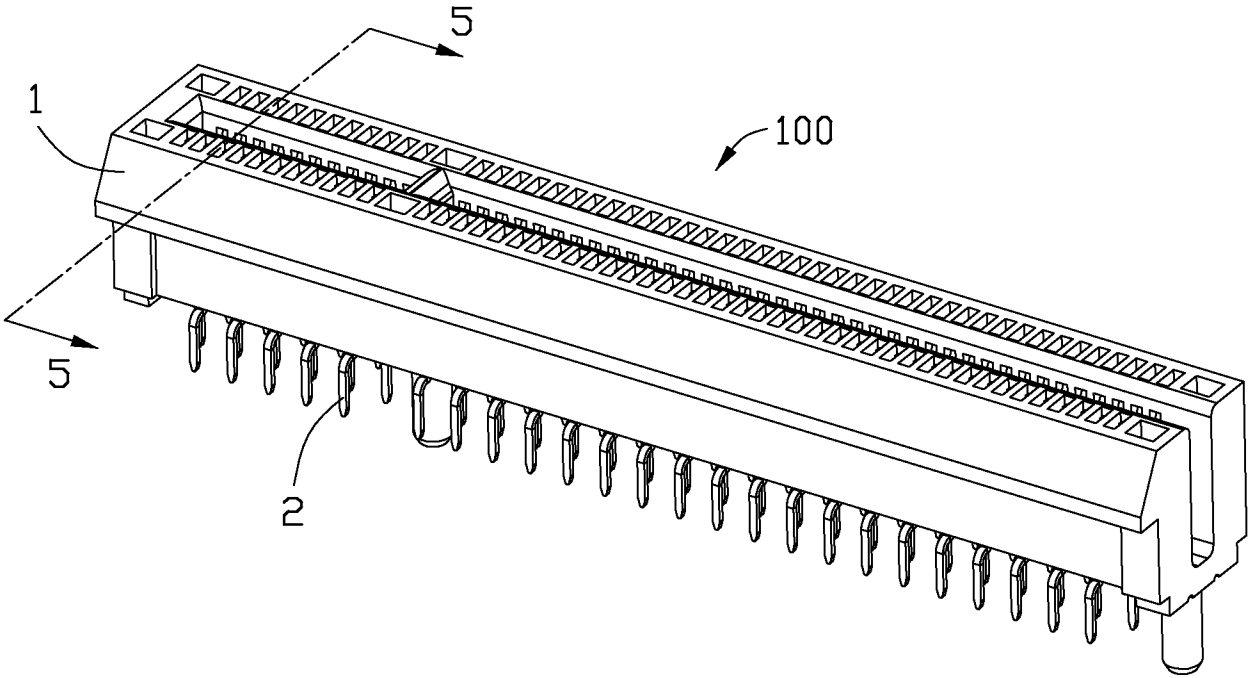
FIG. 1 is a perspective view of an electrical connector in accordance with a first embodiment of the present invention.

Reference will now be made to the drawing figures to describe a preferred embodiment of the present invention in detail. Referring to FIG. 1, an electrical connector 100 is adapted for mounting on a mother board (not shown) to receive a daughter board (not shown). The electrical connector 100 includes an insulative housing 1 extending along a longitudinal direction and a plurality of conductive contacts 2 retained in the housing 1.

Figure 2:
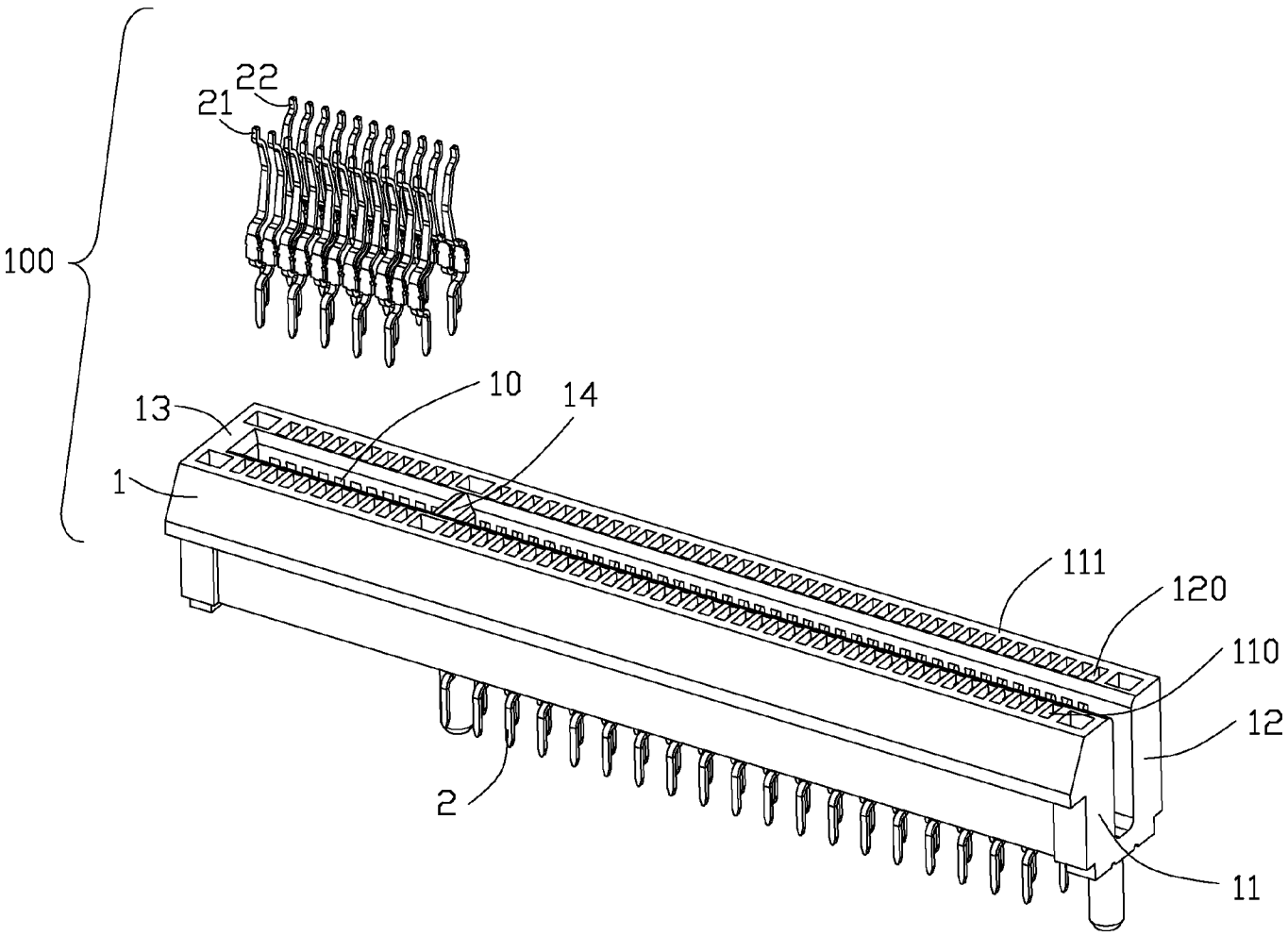
FIG. 2 is a partial exploded perspective view of the electrical connector shown in FIG. 1.
Figure 3:
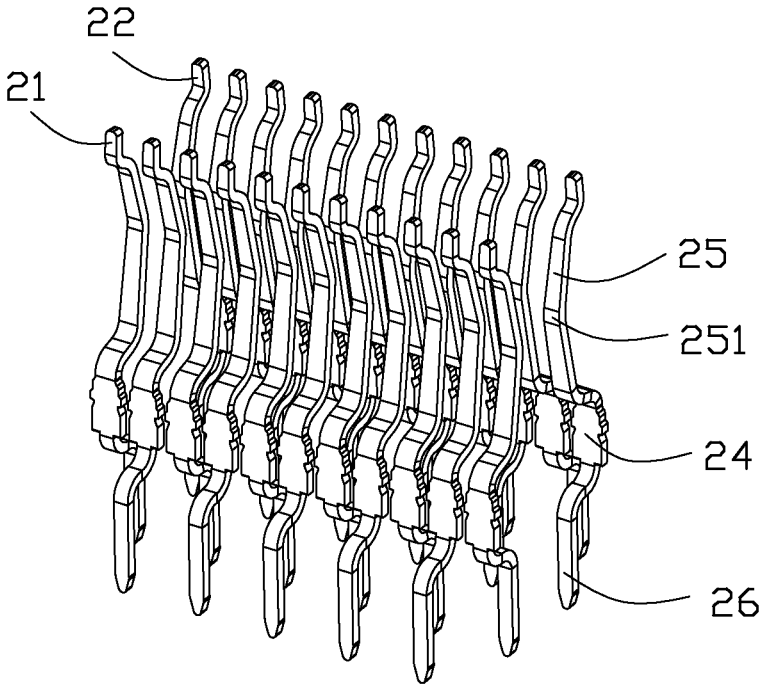
FIG. 3 is a perspective view of partial contacts of the electrical connector shown in FIG. 2.
Figure 4:
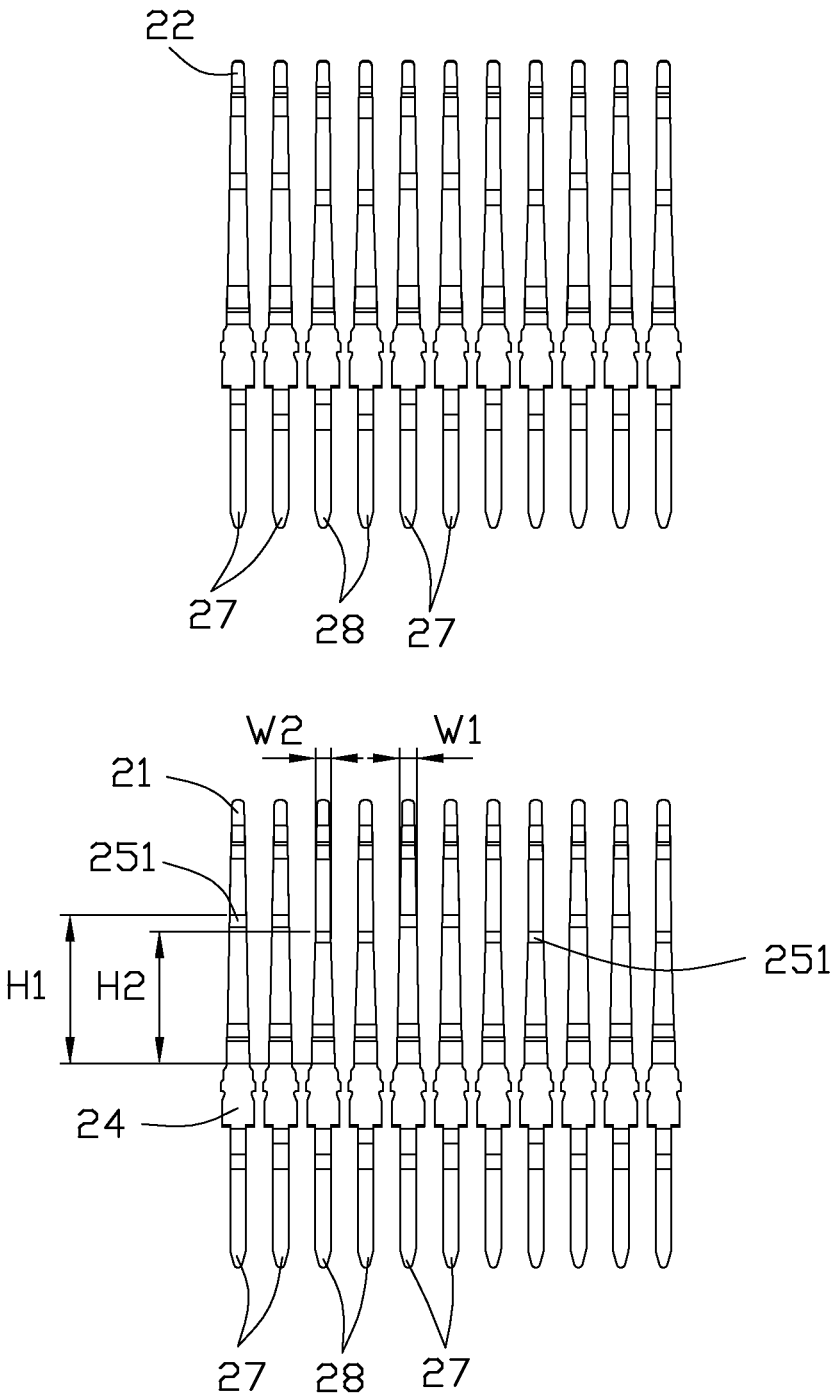
FIG. 4 is a front elevational view of the partial contacts shown in FIG. 3.
Figure 5:
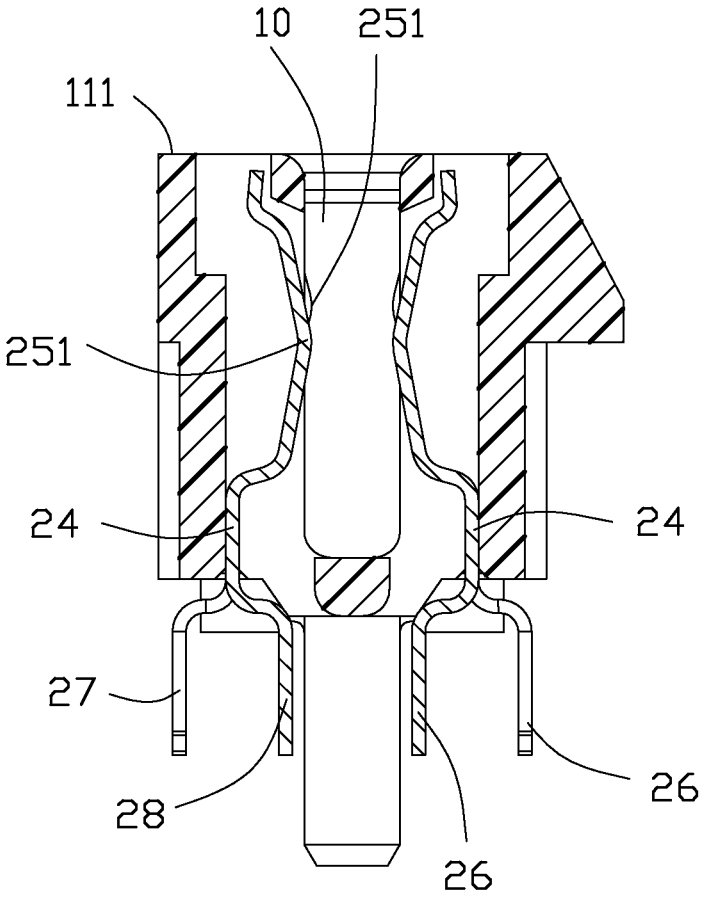
FIG. 5 is a cross-sectional view taken along line 5-5 of FIG. 1.

Referring to FIG. 2, the housing 1 defines a longitudinal slot 10 running through a mating face 111 thereof and located between first and second side walls 11, 12. The first side wall 11 defines a first row of passageways 110 in communication with the longitudinal slot 10. The second side wall 12 also defines a second row of passageways 120 parallel to the first row of passageways 110 and in communication with the longitudinal slot 10. The housing 1 further defines a pair of end walls 13 each disposed at a longitudinal end to connect the first side wall 11 and the second side wall 12, the longitudinal slot 10 runs through one of the end walls 13 to communicate with exterior. A key 14 is disposed in the longitudinal slot 10 and adjacent one of the end walls 13 for anti-mismating of the daughter board.

Referring to FIG. 2 to FIG. 5, the contacts 2 include a row of first contacts 21 disposed in the first side wall 11, and a row of second contacts 22 disposed in the second side wall 12. The first contacts 21 and the second contacts 22 each includes a retention portion 24 retained in the passageway 110, 120 of the side walls 11, 12, a resilient contacting arm 25 upwardly extending from an upper edge of the retention portion 24 in a top-to-bottom direction/mating direction with a contacting portion 251 protruding into the longitudinal slot 10 for mating with the daughter board, and a vertical soldering tail 26 downwardly extending out of the housing 1 from a lower edge of the retention portion 24 in the mating direction. The soldering tails 26 of the contacts 2 are used for being mounted on the mother board. Each row of the first contacts 21 and the second contacts 22 have a same pitch between each two adjacent soldering tails 26.

The row of the first contacts 21 and the second contacts 22 each include at least two pairs of differential pairs 27 for differential signal transmission and a pair of grounding contacts 28 disposed between the adjacent two pairs of differential pairs 27. The upper edges of the retention portions 24 of the contacts 2 are located in a same level in the mating direction. The contacting portions 251 of the two pairs of differential pairs 27 are disposed in a same level in the mating direction, and a first height H1 is provided between each contacting portion 251 of the two pairs of differential pairs 27 and the upper edge of the corresponding retention portion 24. The contacting portions 251 of the pair of grounding contacts 28 are disposed in a same level in the mating direction and a second height H2 which smaller than the first height H1 is provided between each contacting portion 251 of the pair of grounding contacts 28 and the upper edge of the corresponding retention portion 24. The contacting portions 251 of the two pairs of differential pairs 27 are located upper than the contacting portions 251 of the pair of grounding contacts 28 in the top-to-bottom direction. On other words, the contacting portions 251 of the two pairs of differential pairs 27 are closer to the mating face 111 than the contacting portions 251 of the pair of grounding contacts 28 in the mating direction. The two pairs of differential pairs 27 contact with the daughter board earlier than the pair of grounding contacts 28 when the daughter board mates with the electrical connector 100. The contacting portions 251 of the two pairs of differential pairs 27 each defines a first width W1 in the longitudinal direction, and the contacting portions 251 of the pair of grounding contacts 28 each provides a second width W2 smaller than the first width W1 in the longitudinal direction. It could eliminate resonance between each adjacent two pairs of differential contacts 27 after the daughter board is inserted into the electrical connector 100.

Figure 6:
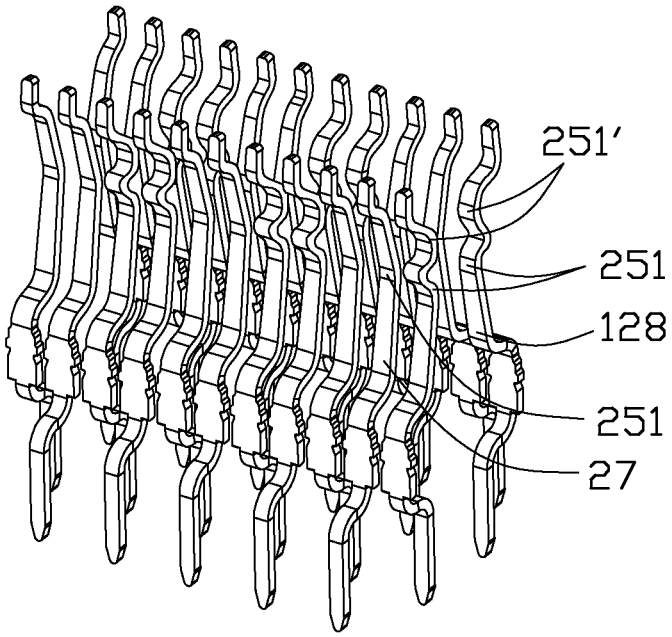
FIG. 6 is a perspective view of the contacts of the electrical connector according to a second embodiment of the invention.
Figure 7:
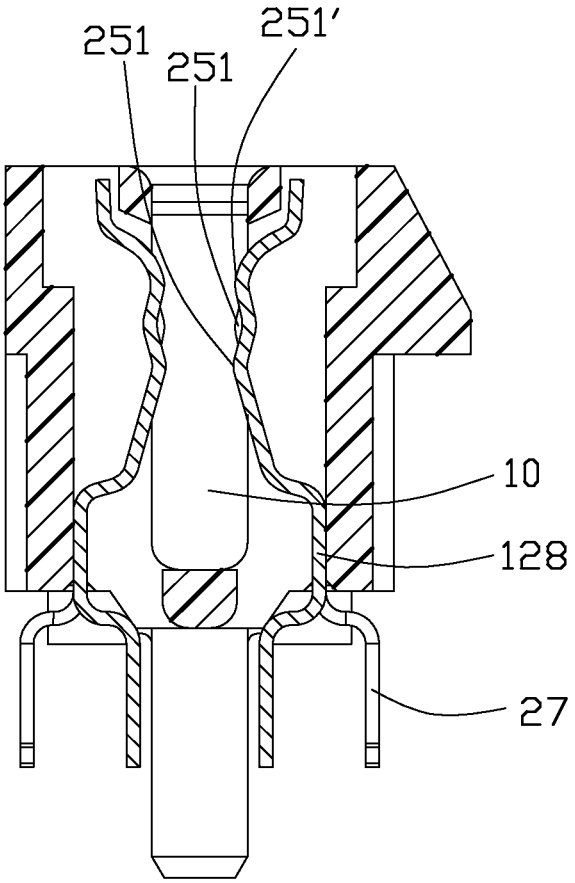
FIG. 7 is a cross-sectional view of the electrical connector according to the second embodiment.
Figure 8:
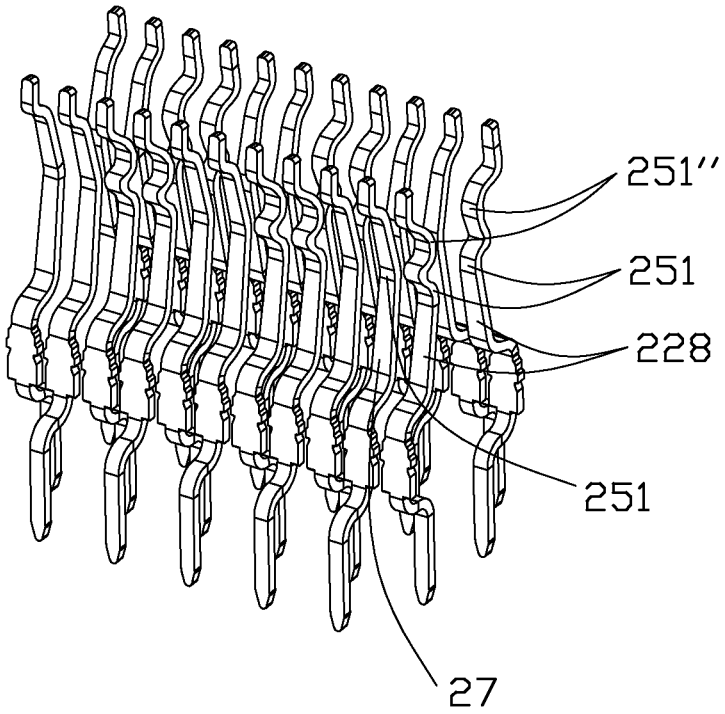
FIG. 8 is a perspective view of the contacts of the electrical connector according to a third embodiment of the invention.
Figure 9:
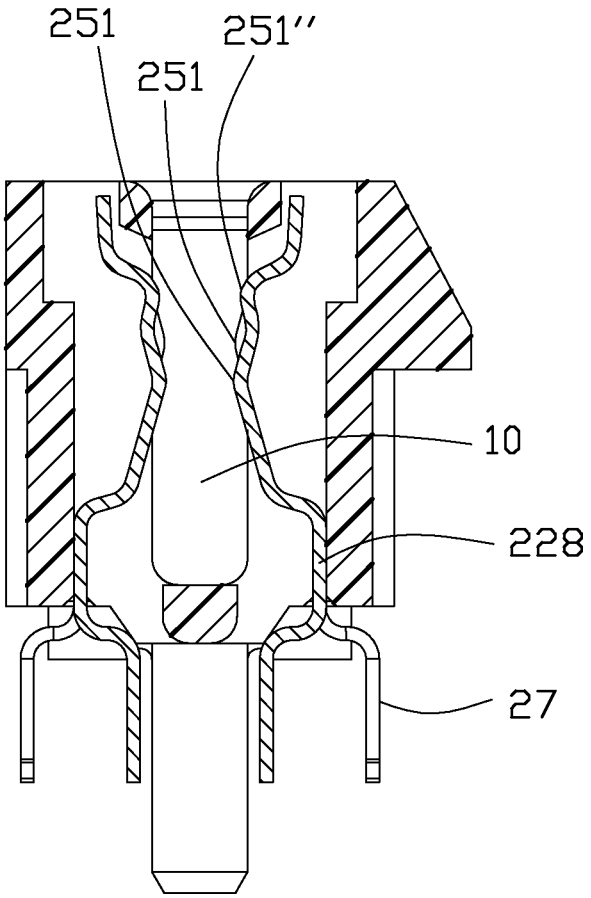
FIG. 9 is a cross-sectional view of the electrical connector according to the third embodiment.

Referring to FIGS. 6-7, the grounding contact 128 further includes another (upper) contacting portion 251' in addition to the original (lower) contacting portion 251 wherein the contacting portion 251' is located higher than the contacting portion 251 of the differential pair 27 for implementing a first ground and second signal operation process during mating. In this embodiment, the contacting portion 251' is initially electrically and mechanically connected to the daughter board before the contacting portions 251 of the differential pair 27 and that of the grounding contact 128 are mechanically connected to the daughter board while is mechanically disconnected from the daughter board when the daughter board is fully received in the central slot 10 and both the contacting portion 251 of the differential pair 27 and that of the grounding contact 128 are mechanically and electrically connected to the daughter board. It is because the contacting portion 251' of the grounding contact 128 is farther from the center line of the housing 1 than the contacting portion 251 of the grounding contact 128 from the center line, and both the contacting portion 251' and the contacting portion 251 are formed on a same resilient contacting arm 25. Referring to FIGS. 8-9, in the third embodiment the contacting portion 251" of the grounding contact 228 is spaced from the center line with a distance same as that between the contacting portion 251 and the center line so both the contacting portion 251" and the contacting portion 251 of the same grounding contact 228 are mechanically and electrically connected to the daughter board when the daughter board is fully received in the central slot 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a longitudinal slot along a longitudinal direction and extending in a mating direction to run through a mating face thereof; and at least one row of contacts retained in the housing, each of the contacts defining a retention portion for being retained to the housing, a resilient contacting arm extending from the retention portion with a contacting portion protruding into the longitudinal slot, and a soldering tail extending out of the housing;

wherein the contacts include at least two differential pairs adjacent to each other and at least one grounding contact sandwiched therebetween in the longitudinal direction, the contacting portions of each differential pairs are closer to the mating face than the contacting portion of the grounding contact in the mating direction.

2. The electrical connector as described in claim 1, wherein all the contacting portions of the two differential pairs are disposed at a same level in the mating direction.

3. The electrical connector as described in claim 2, wherein the electrical connector defines only one pair of grounding contacts sandwiched between the two adjacent differential pairs in the longitudinal direction, the contacting portions of the pair of grounding contacts are disposed at another same level in the mating direction.

4. The electrical connector as described in claim 3, wherein all the contacting portions of the two differential pairs have only one equal first width in the longitudinal direction, and the contacting portion of the pair of grounding contacts have only one equal second width narrower than the first width in the longitudinal direction.

5. The electrical connector as described in claim 1, wherein the retention portions of the contacts are coplanar with one another in one row, and the soldering tails are alternately staggered with one another in two rows located by two sides of said one row of the retention portions.

6. The electrical connector as described in claim 1, wherein the housing defines first and second side walls located at two opposite sides of the longitudinal slot and two end walls respectively disposed at two longitudinal ends to connect the first side wall with the second side wall, the longitudinal slot runs through one of the end walls to communicate with exterior.

7. The electrical connector as described in claim 6, wherein a key is disposed in the longitudinal slot and adjacent to one of the end walls for anti-mismating of a mating component.

8. An electrical connector comprising:

an insulative elongated housing extending along a longitudinal direction, and defining opposite first and second side walls and a longitudinal slot formed therebetween; and a plurality of contacts grouped in a row of first contacts disposed in the first side wall and a row of second contacts disposed in the second side wall, each of the contacts defining a retention portion retained in the housing, a resilient contacting arm upwardly extending from an upper edge of the retention portion in a top-to-bottom direction with a contacting portion projecting into the longitudinal slot, and a soldering tail extending out of the housing from a lower edge of the retention portion in the top-to-bottom direction;

wherein the row of first contacts include a plurality of differential pairs, every adjacent two differential pairs commonly sandwich a pair of grounding contact therebetween in the longitudinal direction, the contacting portions of the plurality of differential pairs all locate upper than the contacting portions of the pair of grounding contacts in the top-to-bottom direction.

9. The electrical connector as described in claim 8, wherein the contacting portions of the plurality of differential pairs all locate in a first height in the top-to-bottom direction, and the contacting portions of the grounding contacts all locate in a second height in the top-to-bottom direction.

10. The electrical connector as described in claim 8, wherein the contacting portions of the plurality of differential pairs have only one equal first width in the longitudinal direction, and the contacting portions of the pair of grounding contacts have only one second width narrower than the first width in the longitudinal direction.

11. The electrical connector as described in claim 8, wherein the retention portions of the row of first contacts are coplanar with one another in one row, and the soldering tails of the row of first contacts are alternately staggered with one another in two rows located by two sides of said one row of the retention portions.

12. The electrical connector as described in claim 8, wherein the housing defines two end walls respectively disposed at two longitudinal ends to connect the first side wall with the second side wall, the longitudinal slot runs through one of the end walls to communicate with exterior.

13. The electrical connector as described in claim 12, wherein a key is disposed in the longitudinal slot and adjacent to one of the end walls for anti-mismating of a mating component.

14. An electrical connector for use with a daughter board, comprising:

an insulative housing defining an elongated receiving slot extending along a longitudinal direction and exposed to an exterior via a mating face in a mating direction perpendicular to said longitudinal direction; and a plurality of contacts disposed in the housing at least by one side of the said receiving slot and including differential pairs and grounding contacts alternately arranged with each other along said longitudinal direction, each of said contacts including a contacting arm extending into the receiving slot for mating with the daughter board and a tail extending outside of the housing for mounting to a mother board, the contact arm defining at least one contacting point for mating with the daughter board when the daughter is fully received in the receiving slot, and the contacting point of each of the differential pair being located closer to the mating face than that of the grounding contact to the mating face; wherein the contacting arm of the grounding contact further includes another contacting point which is closer to the mating face than that of each of the differential pair to the mating face.

15. The electrical connector as claimed in claim 14, wherein said another contacting point is electrically and mechanically connected to the daughter board when the daughter board is initially inserted into the receiving slot at an initial position while either mechanically connected or not mechanically connected to the daughter board when the daughter board is finally fully received in the receiving slot at a final position.

16. The electrical connector as claimed in claim 15, wherein said another contacting point of the grounding contact is farther from a center line of the housing than the contacting point of the grounding contact from said center line where said another grounding contact is not mechanically connected to the daughter board when said daughter board is fully received in the receiving slot at the final position.

17. The electrical connector as claimed in claim 16, wherein the contacting point of each of the differential pair is spaced from the center line with a distance substantially same as that of the contacting point of the grounding contact from the center line.

* * * * *